US012352267B1

(12) United States Patent
Huang et al.

(10) Patent No.: US 12,352,267 B1
(45) Date of Patent: Jul. 8, 2025

(54) ROTARY LOBE BLOWER OR VACUUM PUMP WITH SYNCHRONIZED INDUCTION AND DISCHARGE FLOWS (SIDF)

(71) Applicants: Paul Xiubao Huang, Fayetteville, GA (US); Sean William Yonkers, Georgetown, GA (US)

(72) Inventors: Paul Xiubao Huang, Fayetteville, GA (US); Sean William Yonkers, Georgetown, GA (US)

( * ) Notice: Subject to any disclaimer, the term of this patent is extended or adjusted under 35 U.S.C. 154(b) by 0 days.

(21) Appl. No.: 18/611,868

(22) Filed: Mar. 21, 2024

(51) Int. Cl.
*F04C 18/12* (2006.01)

(52) U.S. Cl.
CPC ..... *F04C 18/126* (2013.01)

(58) Field of Classification Search
CPC ..... F04C 18/126
See application file for complete search history.

(56) References Cited

U.S. PATENT DOCUMENTS 2,454,048 A * 11/1948 Flanagan ..... F04C 29/0035 418/206.6
3,844,695 A * 10/1974 Weatherston ..... F04C 18/088 418/206.5
6,638,042 B1 * 10/2003 Holden ..... F04C 29/042 418/197
2023/0097255 A1 * 3/2023 Huang ..... F04C 29/0035 418/201.1

OTHER PUBLICATIONS

GB 2 088 957 (Year: 1982).*

* cited by examiner

*Primary Examiner* — Anthony Ayala Delgado

(57) ABSTRACT

Synchronized Induction & Discharge Flows (SIDF) for a rotary lobe blower (pump) or vacuum pump reduce flow pulsations, noise, vibration, harshness (NVH) and improve blower efficiency. Generally, a rotary lobe blower (pump) or vacuum pump with a SIDF has a pair of mechanically synchronized multi-lobe rotors with the same number of lobes housed in a well of a casing wall with an off-center suction port and discharge port. The fluid being trapped by adjacent lobes of each of the rotors and the walls along two flanks of the walls of the well are synchronized wherein the suction port and the discharge port have each an axis that are parallel with each other; the suction port axis and the discharge port axis being offset with each other; wherein the offset provides simultaneous fluid inducting for the two flanks at the suction port and simultaneous fluid back filling and discharging for the two flanks at the discharge port respectively.

2 Claims, 3 Drawing Sheets

Suction Cell A&B trap in sync

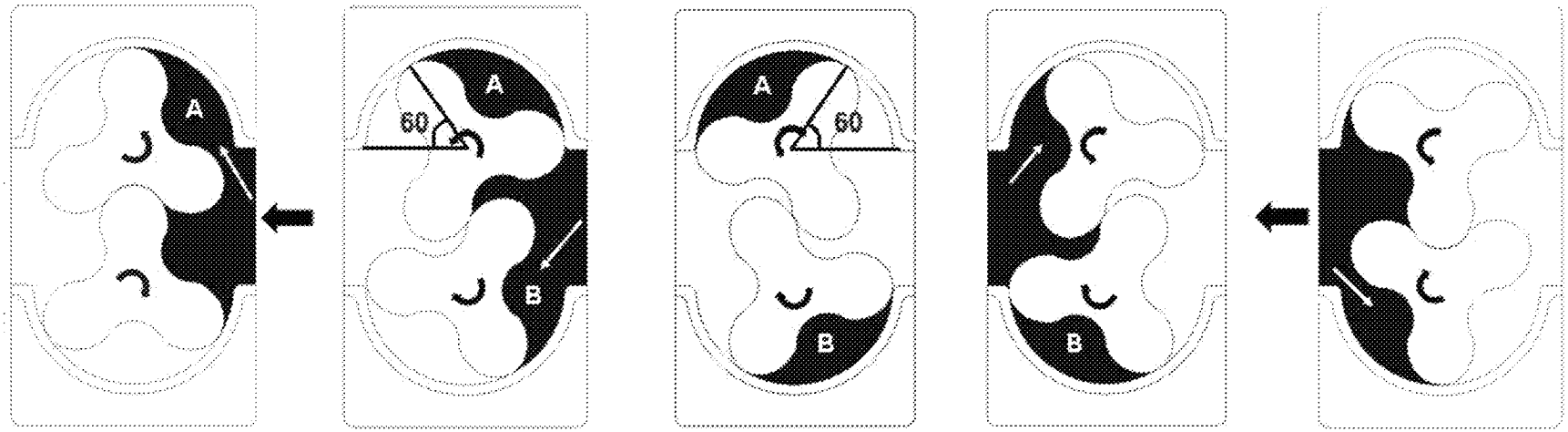
FIG. 1A Prior Art — Suction
FIG. 1B Prior Art — Trapping
FIG. 1C Prior Art — Transport
FIG. 1D Prior Art — Compression
FIG. 1E Prior Art — Discharge A
B
30°
Suction
Cell A trap (Prior)
Cell A&B trap in sync
Transport in sync
Backflow & Discharge

ROTARY LOBE BLOWER OR VACUUM PUMP WITH SYNCHRONIZED INDUCTION AND DISCHARGE FLOWS (SIDF)

BACKGROUND OF THE INVENTION

1. Field of the Invention

The present invention relates generally to a double rotor multi-lobe type blower or vacuum pump commonly known as rotary lobe type, Roots type blowers or superchargers (as used in internal combustion engine), and more specifically relates to a Roots blower with synchronized induction and discharge flows (called SIDF in this article) for reducing flow pulsations and induced vibration, noise and harshness (NVH) and improving blower efficiency.

2. Description of the Prior Art

Structurally, a classical Roots blower consists of two identical and parallel rotors that have the same multi-lobes (2, 3 or 4) meshing cooperatively inside an airtight casing. The casing forms a well and has inlet and outlet ports (each port has an axis that are mostly aligned) generally arranged on opposite sides of the well and centered between two rotor axes. The two rotors counter-rotate and are synchronized non-contact by a set of timing gears inside the casing wall. Air is displaced from the suction to the discharge port by the outward motion of the lobes along two flanks of the casing walls and the rate of airflow from the displacement is governed primarily by the rotational speed of the rotors and total cavity space between the two flanks of casing walls and rotating lobes known as the CFR (cubic feet per rev, a measure of the volumetric flow rate) of a Roots blower.

The working principle of a traditional Roots blower can be illustrated by following one flow cell or fluid cavity in a complete compression cycle for a 3-lobe rotary blower as shown in FIGS. 1*a* to 1*e*. Let's first focus on the top rotor as air first enters into space or cavity or cell between two lobes of the top rotor and surrounding casing wall as the cavity A is open to blower suction port during the outward rotation from inlet to outlet. With continuing rotation, the air in cavity A becomes fully trapped at lobe position shown in FIG. 1*b*, and transported shown in FIG. 1*c* from the blower suction to discharge port, and there is no gas compression and no cavity volume change taking place during these two phases. But as soon as the trapped flow cell A is opened to the outlet port as shown a little later in FIG. 1*d*, a series of compression waves or shock waves and induced back flow is generated and rushed into cavity A due to sudden opening to a higher outlet pressure in a mechanism like a diaphragm breaking open in a shock tube [Refs. 1&2]. The shock wave sweeps through the air in cavity A and compresses it almost instantaneously to the outlet gas pressure. Then the top lobes meets the lower lobes from the bottom rotor, meshing out the compressed air to the outlet port and return to inlet suction position to start the next cycle, as shown in FIG. 1*e*.

An exactly same cycle takes place for the bottom rotor as air enters into space or cavity between the lobes of the bottom rotor and surrounding casing wall as fluid cavity B is open to the blower inlet port as shown in FIG. 1*b*. However, due to a phase shift of 60 degrees for a 3 lobe rotor (90 degrees for a 2-lobe rotor, 45 degrees for a 4-lobe rotor) of the top and bottom lobe angular positions, the flow cell B in the lower flank is exactly out of phase with the flow cell A in the upper flank by 60 degrees. In other words, the top flow path shown as A and the bottom flow path B are acting like two independent positive displacement blowers sharing a common inlet port and common outlet port and operating in parallel but out of sync by 60 degrees. The unique shockwave compression mechanism of the Roots blower and out of phase paralleled flows by two rotors inherently result in two types of flow pulsations: gas pressure pulsations at blower discharge induced by inlet/outlet pressure difference and gas velocity pulsations at blower suction and discharge induced by flow velocity directional swing caused by feeding out of phase top and bottom cavities as shown by the small white arrows in FIGS. 1*a* & 1*b* and 1*d*& 1*e* respectively. It can be seen that the velocity directional swing for classical Roots is quite large in magnitude, more than 90 degrees in average.

A proposed new mechanism and solution for the first type flow pulsation (pressure pulsation) is already described in Refs. [3, 4] and the focus of the current invention is dealing with the second type flow pulsations—velocity pulsations at blower suction and discharge due to large flow velocity directional swing at a frequency that is equal to: blower RPM×2 (number of rotors)×3 (number of lobes for each rotor). As rotor speed and number of lobes increase, the high frequency flow swing becomes more difficult to overcome due to flow inertia (Newton's Law of Inertia) and would result in imperfect inflow filling and backflow filling of rotating cavities at blower suction and discharge respectively. This in turn would lead to induced NVH and poor blower efficiency.

Accordingly, it is always desirable to provide a new design and construction of a rotary lobe blower that is capable of achieving high reduction of flow pulsations and induced NVH at the source and improving blower efficiency while being kept light in mass, compact in size and suitable for high speed and high pressure ratio applications at the same time.

SUMMARY OF THE INVENTION

It is an object of the present invention to provide a rotary lobe blower with a SIDF (Synchronized Induction & Discharge Flows) for reducing flow pulsations at source.

It is a further object of the present invention to provide a rotary lobe blower with a SIDF that is capable of achieving higher blower volumetric and adiabatic efficiency.

It is a further object of the present invention to provide a rotary lobe blower with a SIDF that is capable of achieving higher speed and higher blower efficiency.

BRIEF DESCRIPTION OF THE DRAWINGS

Referring particularly to the drawings for the purpose of illustration only and not limited for its alternative uses, there is illustrated:

FIGS. 1*a* to 1*e* (PRIOR ART) show the aligned inlet and outlet port and phases of a Roots compression cycle by cross-sectional side views of a classical rotary lobe blower;

DETAILED DESCRIPTION OF THE PREFERRED EMBODIMENT(S)

Although specific embodiments of the present invention will now be described with reference to the drawings, it should be understood that such embodiments are examples only and merely illustrative of, but a small number of, the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

It should also be pointed out that though drawing illustrations and description are devoted to a straight 3-lobe rotary air blower in the present invention, the principle can be applied to other types of rotary lobe blowers with different numbers of lobes such as two-lobed, four-lobed or five-lobed, etc.. Moreover, lobes can be either straight or twisted in its axial direction as long as both rotors have the same number of lobes. The principle can also be applied to other gases or liquid media, such as lobe or gear pumps which are variations of Roots type blowers for liquid and the later uses involute lobe shape to allow the lobes to function as gears with rolling interfacial contact. In addition, lobe type expanders are the above variations too except being used to generate shaft power from media pressure drop.

As a brief introduction to the principle of the present invention, FIGS. 2*a* to 2*e* show again a complete cycle of Roots compression for a 3-lobe rotary blower with an off-centered suction port and an off-centered discharge port in order to synchronize the induction & discharge flows (SIDF). As implied by its name, SIDF is used to compensate out of phased two flanks of suction inflows (same for out of phased two flanks of discharge backflows and outflows), hence attenuating flow velocity swing pulsations. This is achieved structurally by angularly shifting the centered suction port 30 degree in one way for a 3-lobe rotor (45 degree for a 2-lobe rotor, 22.5 degree for a 4-lobe rotor) and the centered discharge port 30 degree in the opposite way of the suction port shifting so that total angular shifting of the inlet and outlet port is 60 degree (90 degree for a 2-lobe rotor, 45 degree for a 4-lobe rotor).

As illustrated in FIGS. 2*a* to 2*e*, the top rotor cavity or cell A and the bottom rotor cavity or cell B are now in sync during suction, trapping and transporting, backfilling and discharge phases. This results in simultaneous air inducting for two flanks of flow at blower inlet and simultaneous air backfilling and discharging for two flanks of flow at blower outlet respectively, hence getting rid of flow pulsations due to large flow velocity directional swing at high frequency, and improving blower volumetric and adiabatic efficiency at the same time.

Figures 2A, 2B, 2C, 2D, 2E:
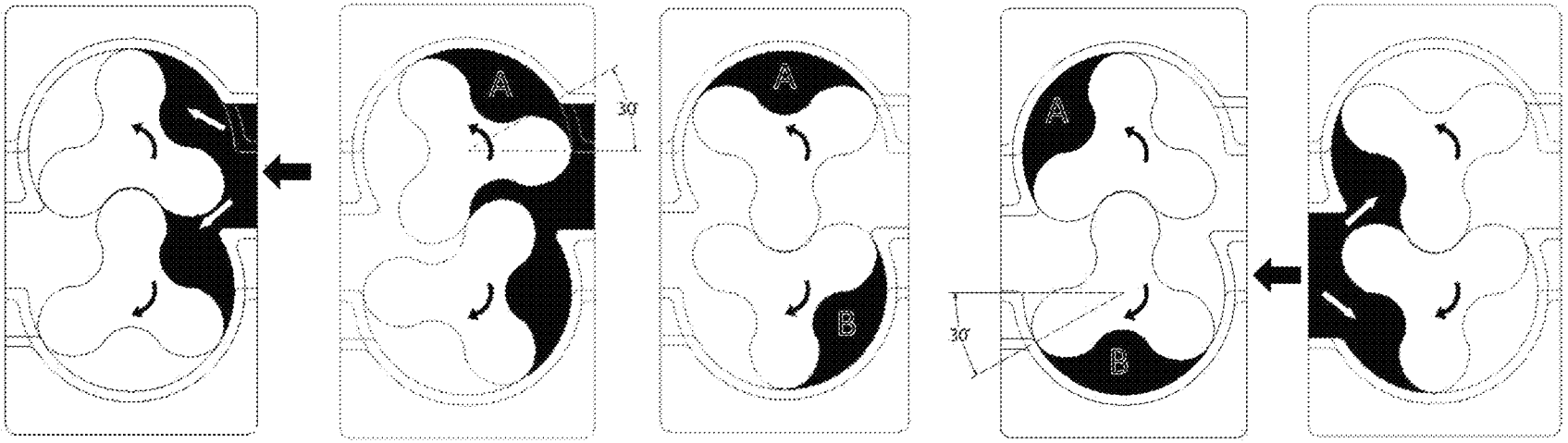
FIGS. 2*a* to 2*e* show the inlet and outlet port shifting 60 degrees and phases of the new Roots compression cycle of the first embodiment of the present invention SIDF.
Figures 3A, 3B:
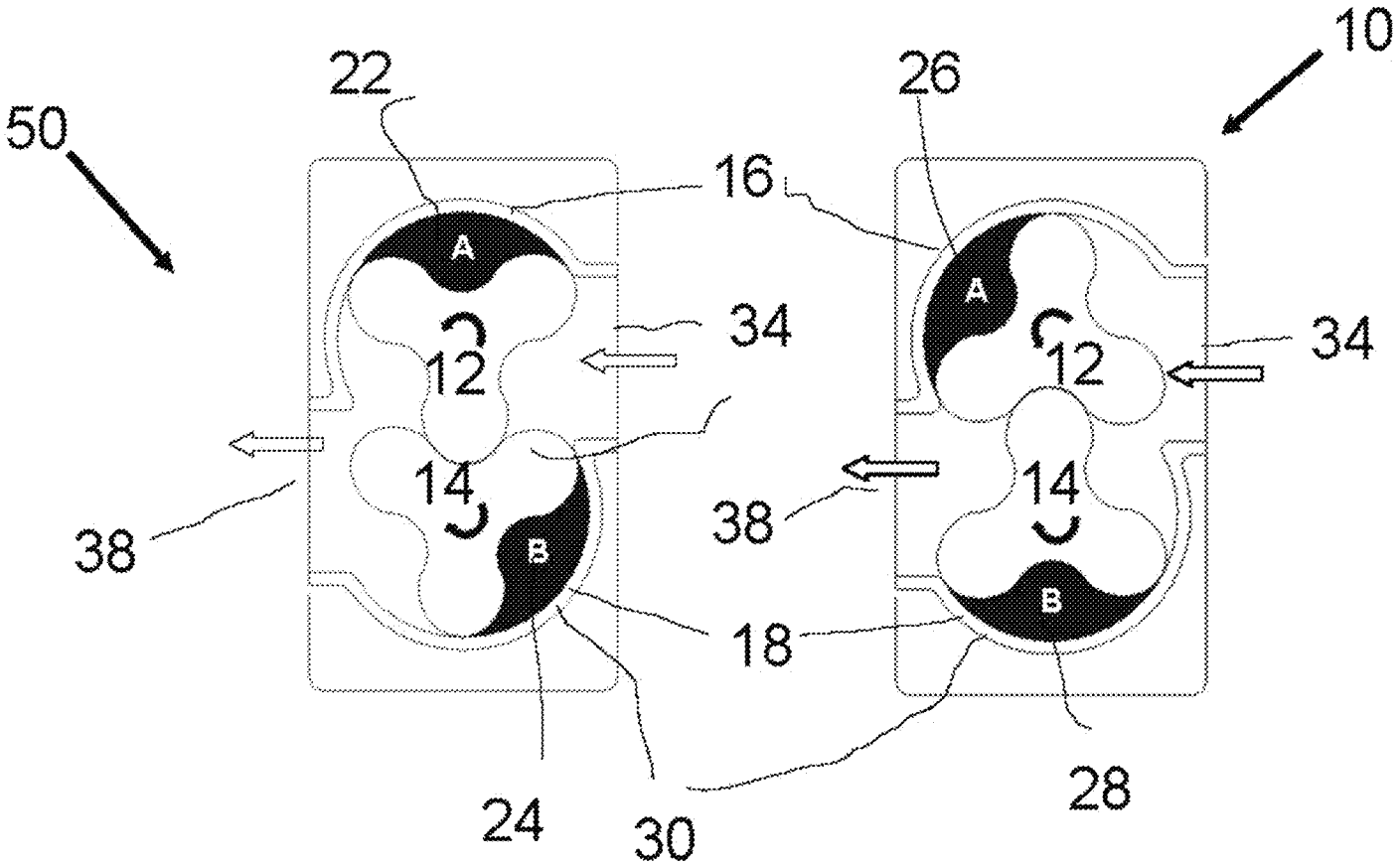
FIGS. 3*a* and 3*b* show the cross-sectional side views of the first embodiment of the present invention SIDF with rotor lobes in sync with suction port and discharge port respectively.

Referring to FIGS. 3*a* and 3*b*, there is shown a typical arrangement of a preferred embodiment of a rotary blower 10 with a synchronized Induction & Discharge Flows (SIDF) 50 respectively. Typically, the rotary blower 10 has two parallel rotors 12 and 14 mounted on rotor shafts (not shown) respectively, where rotor 12 shaft driven by an external rotational driving mechanism and through a set of timing gears (not shown) drives the rotor 14 in synchronization without touching each other for propelling fluid flow from a suction port 34 to a discharge port 38 generally arranged on opposite sides of the blower casing wall 30 of the blower 10. As an important novel and unique feature of the present invention, a synchronized induction & discharge flow (SIDF) apparatus 50 is synchronizing induction fluid cavities 22 and 24 along the corresponding two flanks 16 and 18 of casing wall 30 from the off-centered suction port 34 as illustrated in FIG. 3*a*, and at the same time, is synchronizing discharge fluid cavities 26 and 28 from the corresponding two flanks 16 and 18 of casing wall 30 through the off-centered discharge port 38 of the blower 10 as illustrated in FIG. 3*b*.

In the embodiment illustrated in FIG. 3*a*, the synchronized induction & discharge flow (SIDF) apparatus 50 is working as follows. As two lobe tips 11 & 13 just pass over the inlet port 34 closing position, suction inflow into two flanks 16 & 18 of fluid cavities 22 & 24 are synchronized due to angularly shifted suction port 30 degree off center (for 3-lobe rotor) while discharge backflow and outflow out of the two flanks 16 & 18 of fluid cavities 26&28 are also synchronized due to angularly shifted discharge port 30 degree off center in the opposite direction of the suction port shifting.

When a rotary blower 10 is equipped with the synchronized induction & discharge flow (SIDF) apparatus 50 of the present invention, there exist both a reduction of flow pulsations and induced NVH at source and improvement of blower efficiency while being kept light in mass, compact in size and suitable for high speed and high pressure ratio applications at the same time.

It is apparent that there has been provided in accordance with the present invention a rotary blower with a SIDF for reducing the high pulsations without increasing overall size of the blower. While the present invention has been described in context of the specific embodiments thereof, other alternatives, modifications, and variations will become apparent to those skilled in the art having read the foregoing description. Accordingly, it is intended to embrace those alternatives, modifications, and variations as fall within the broad scope of the appended claims.

REFERENCES

1. Huang, P., Gas Pulsations: A Shock Tube Mechanism. The 2012 International Compressor Engineering Conference at Perdue, 2012a.
2. Huang, P., Under Compression: An Isochoric or Adiabatic Process? The 2012 International Compressor Engineering Conference at Perdue, 2012b.
3. Huang, P., Yonkers, S., Rotary Lobe Pump or Vacuum Pump with Shunt Pulsation Trap, U.S. Pat. No. 9,140,260, 2015.
4. Huang, P., Yonkers, S., Hokey, D., Gas Pulsation Control Using a Shunt Pulsation Trap. The 2014 International Compressor Engineering Conference at Perdue, 2014.

What is claimed is:

1. A rotary blower with a Synchronized Induction & Discharge Flows (SIDF) apparatus, comprising:

a. a casing having a suction port, a discharge port and walls defining a well therein;

b. two multi-lobe rotors with the same number of lobes located in said well interconnected through a set of timing gears to counter-rotate in synchronization such that fluid is passing through the said suction port to the said discharge port;

c. the said fluid being trapped by adjacent said lobes of each of said rotors and the said walls along two flanks of the said walls of the said well are synchronized wherein the said suction port and the said discharge port have each an axis that are parallel with each other, the said suction port axis and the said discharge port axis being offset with each other; said offset provides simultaneous fluid inducting for said two flanks at said suction port and simultaneous fluid back filling and discharging for said two flanks at said discharge port respectively;

d. whereby said rotary blower is achieving high pulsation and NVH reduction at source and improving blower efficiency while being kept light in mass, compact in size.

2. The rotary blower with Synchronized Induction & Discharge Flows (SIDF) apparatus as claimed in claim 1, wherein said suction port and said discharge port are angularly shifted with respect to each other 90 degrees for said 2-lobe rotor, or 60 degrees for said 3-lobe rotor, or 45 degrees for said 4-lobe rotor.

* * * * *